US006964420B1

(12) United States Patent
Ghanizadeh et al.

(10) Patent No.: US 6,964,420 B1
(45) Date of Patent: Nov. 15, 2005

(54) ROLLING RECORD CASE WITH HANDLE

(75) Inventors: Atousa Ghanizadeh, Los Angeles, CA (US); Jesus O. Talamantez, 663 N. Lillian Way, Los Angeles, CA (US) 90004

(73) Assignee: Jesus O. Talamantez, Studio City, CA (US)

( * ) Notice: Subject to any disclaimer, the term of this patent is extended or adjusted under 35 U.S.C. 154(b) by 0 days.

(21) Appl. No.: 10/118,356

(22) Filed: Apr. 9, 2002

Related U.S. Application Data

(60) Provisional application No. 60/282,122, filed on Apr. 9, 2001.

(51) Int. Cl.[7] ..... B62B 1/00

(52) U.S. Cl. ..... 280/47.131; 280/47.26; 280/37; 190/110

(58) Field of Search ..... 280/47.26, 47.24, 280/47.17, 47.131, 47.33, 63, 37; 206/307.1, 206/313; 190/109, 110, 116, 18 A, 115

(56) References Cited

U.S. PATENT DOCUMENTS

| | | | | | |
|---|---|---|---|---|---|
| 4,574,944 | A | * | 3/1986 | Gregory | 206/5.1 |
| 5,485,922 | A | * | 1/1996 | Butcher | 206/576 |
| 5,528,453 | A | * | 6/1996 | Berman et al. | 361/625 |
| 5,806,673 | A | * | 9/1998 | Sanderson | 206/314 |
| 5,823,550 | A | | 10/1998 | Bennett et al. | |
| D402,462 | S | * | 12/1998 | Sanderson | D3/276 |
| 6,036,203 | A | | 3/2000 | Tyus et al. | |
| 6,061,871 | A | * | 5/2000 | Wang | 16/113.1 |
| 6,073,944 | A | * | 6/2000 | Moore | 280/47.26 |
| 6,105,763 | A | * | 8/2000 | Saetia | 206/320 |
| 6,298,964 | B1 | * | 10/2001 | Sadow | 190/18 A |
| 6,371,288 | B1 | * | 4/2002 | Licata | 206/214 |
| 6,497,311 | B2 | * | 12/2002 | Tiramani et al. | 190/115 |
| 6,520,514 | B2 | * | 2/2003 | Clegg | 280/47.26 |

* cited by examiner

*Primary Examiner*—Brian L. Johnson
*Assistant Examiner*—Brian Swenson
(74) *Attorney, Agent, or Firm*—Krieg DeVault Lundy LLP

(57) ABSTRACT

A rolling record case has a removable frame having an adjustable handle and rotatable wheels. Two frame mounting brackets are secured to the record case. Frame includes a spring loaded manual release portion for enabling quick manual attachment or removal of the frame portion to the record case. The frame supports an extendable handle portion, in which manual actuation of a release member on the handle, enables the handle portion to extend to a first intermediate position, a second fully extended position, or to a fully retracted position. The rolling record case includes a hinged lid with one or more securing latches to secure the lid in a closed position, and a compartmented interior. A slideable latch member is extended or retracted by rotation of a handle. The compartments inside the case portion can include visible compartments as well as one or more hidden compartments. The hidden compartment can be formed by a false bottom in one or more of the visible compartments.

41 Claims, 8 Drawing Sheets

ROLLING RECORD CASE WITH HANDLE

This application claims the benefit of provisional application No. 60/262,122 filed Apr. 9, 2001.

FIELD OF THE INVENTION

The present invention relates to a record case having wheels and a handle, and more particularly, the present invention relates to a record case having wheels and an adjustable handle mounted on a frame which is secured to the rolling record case.

BACKGROUND OF THE INVENTION

Rolling cases are known in the luggage and carrier arts.

U.S. Pat. No. 5,823,550 to Bennett et al. teaches a portable case for trade show materials. The case has built-in wheels as well as a built-in handle.

U.S. Pat. No. 6,036,203 to Tyus et al. teaches a tool dolly. The dolly has wheels, a handle, and a multi-compartmented case with hinged doors for each compartment.

U.S. Pat. No. 6,073,944 to Moore teaches a school supplies transporting device. The device includes a container having an attached telescoping handle, and which incorporates an axle and attached wheels.

U.S. Pat. No. 5,528,453 to Berman et al. teaches a video recording traveling cart. The cart includes an extensible handle portion.

SUMMARY OF THE INVENTION

From the foregoing, it is seen that it is a problem in the art to provide a record case having a removable frame with wheels and an extendable handle. According to the present invention, a device and process are provided which meets the aforementioned requirements and needs in the prior art. Specifically, the device according to the present invention provides a rolling record case having a removable frame with wheels and an adjustable handle. The frame is releasably secured to a pair of brackets secured to the record case.

More particularly, the invention relates to a rolling record case having a frame with wheels and an adjustable handle. In a first embodiment, the frame is releasably secured to a pair of spaced brackets secured to the record case. In an alternate second embodiment, the frame is secured directly to the record case. The record case includes a container portion with a lockable and removable lid. The frame includes a spring loaded manual frame release portion for enabling quick manual attachment or removal of the frame portion to the record case portion.

Further, the handle includes a handle extension feature, in which manual actuation of a handle release member enables extending the length of the handle portion to a first intermediate extended position, or further extending the length of the handle to a second fully extended position. The handle release member also enables the user to move the first and second handle portions to a fully retracted position.

Additionally, the case portion of the record case includes a hinged lid which is removable from the record case, and at least one securing latch to secure the lid in a closed position. The compartmented interior is sized to receive a plurality of vinyl records therein.

The latch portion preferably includes a slidable latch member, having a handle which is rotatably positioned to bias the latch member between open and closed positions.

The slidable latch member is engagable with a catch member secured to a complimentary depending side of the lid.

The compartments inside the case portion include one or more visible compartments, as well as one or more hidden compartments. The hidden compartment is formed by a false bottom panel located in spaced relation from the bottom surface of the record case.

Additionally, the record case is fitted with at least one mounting bracket, which is secured to the back side of the record case in alignment with a mounting catch that is located on the depending back side of the lid. The mounting brackets are preferably secured to the record case so that the mounting catch on the lid and the mounting bracket on the record case are on the same side of the record case as the mounting brackets used to secure the frame to the record case.

Further, the case portion, has compartments sized especially for receiving items for a music entertainment specialist commonly referred to as a DJ, or disk jockey. The compartments can be sized to include, for example, a compartment for vinyl records such as LP (long playing) records for 33 and ⅓ speed or 78 speed. Other compartments can be used to provide a place for cleaning fluids or cloths, microphones, wires, or other equipment used by the disk jockey. Other sizes of compartments can be used, if desired, for other types of records or CD's (compact disks) or DVD's, for example.

Other objects and advantages of the present invention will be more readily apparent from the following detailed description when read in conjunction with the accompanying drawings.

DETAILED DESCRIPTION OF THE INVENTION

Figure 1A:
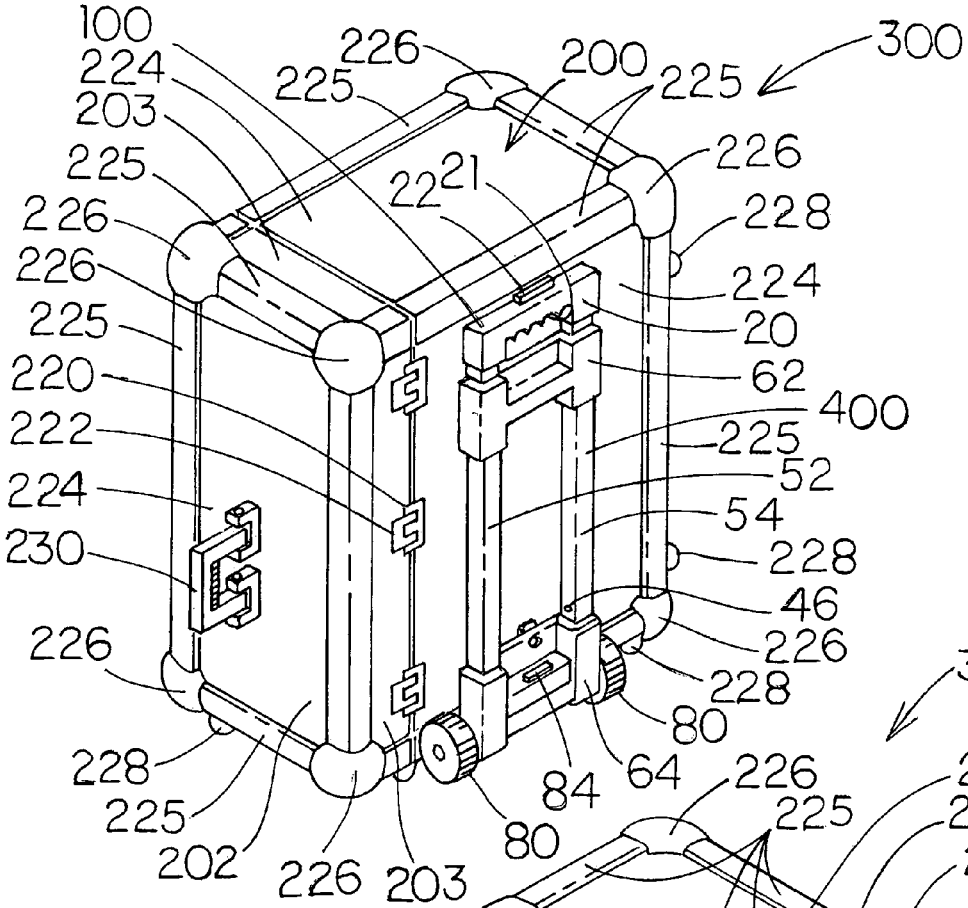
FIG. 1A is a perspective view of the rear of the rolling record case, showing the frame member with wheels and an extendable handle releasably secured to the rolling record case container, according to the present invention.
Figure 1B:
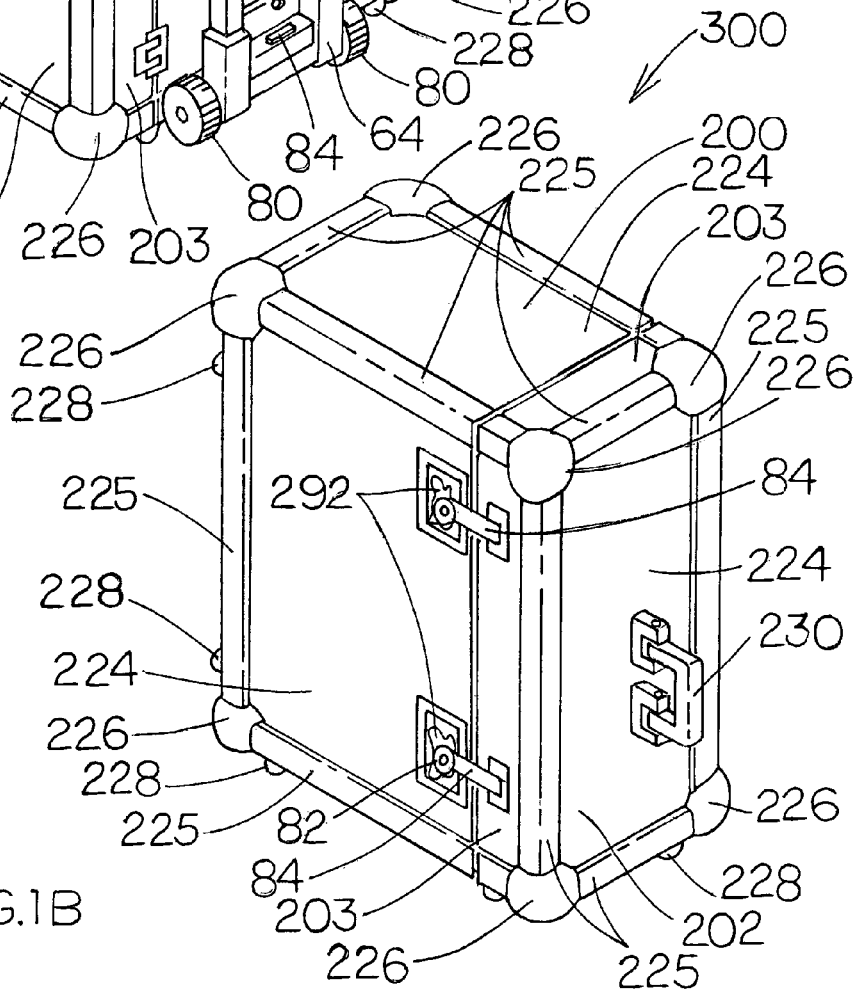
FIG. 1B is a perspective view of the front of the container, showing the latching apparatus.

FIG. 1A and FIG. 1B show perspective views of a rolling record case apparatus 300, having a frame 400 for supporting an extendable handle 100 and wheels 80. The rear view of the record case housing 200 is shown in perspective view in FIG. 1A. The extendable handle portion 100 includes a hand grip portion 20. Preferably, the lower surface 21 of the hand grip portion 20 is molded to conform to the grip of a user's fingers.

Figures 2A, 2B, 2C:
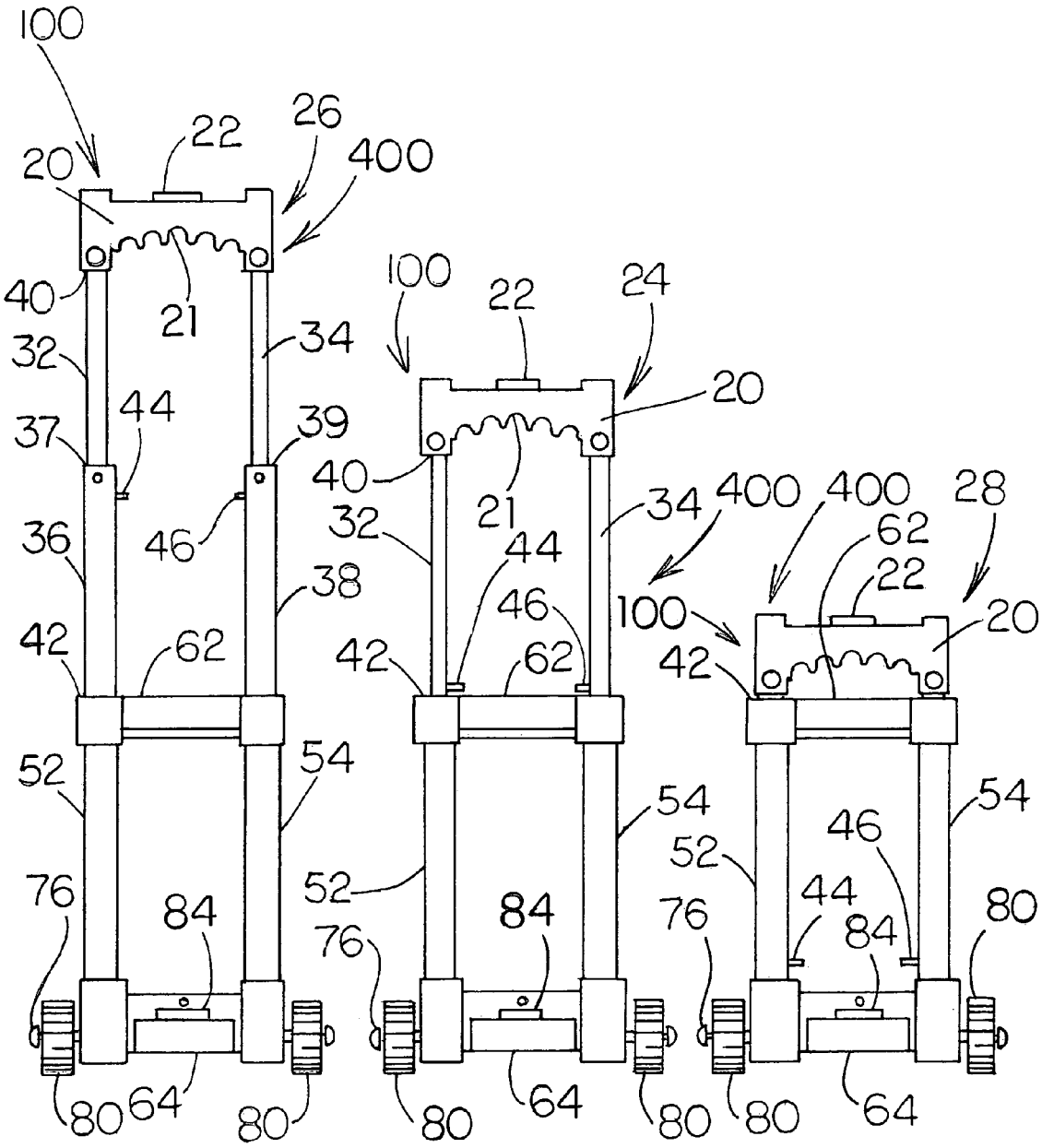
FIG. 2A is an elevation view of the extendable handle apparatus, showing the handle releasably secured in a fully extended position.
FIG. 2B is an elevation view of the extendable handle apparatus, showing the handle releasably secured in an intermediate position.
FIG. 2C is an elevation view of the extendable handle apparatus, showing the handle releasably secured in a fully retracted position.

The hand grip portion 20 carries a release latch 22 which, when depressed, enables the hand grip portion 20 to extend as shown in FIG. 2A and FIG. 2B, or retract as shown in FIG. 2C. The handgrip portion 20 preferably extends to a first intermediate position 24, which is useful for carrying the record case over curbs, up or down stairs, lifting the record case 200 into or out of a vehicle, and while traversing over other obstacles. The hand grip portion 20 is also preferably extendable to a second fully extended position 26, which is useful when pulling or pushing the record case over pavement, sidewalks and floors. The hand grip portion 20 is also designed to be releasably secured in a third, fully retracted position 28, as shown in FIG. 2C.

FIG. 1B shows the front view of the record case 200, with the slidable latch member 282 engaged in the catch member 84.

As shown in FIGS. 2A through 2C, the handle portion 100 includes a hand grip portion 20 having a releasable handle latch 22. The handle end 40 of the first and second tubular arms 32, 34 are secured in parallel, spaced relation to the hand grip portion 20. The distal end 37 of the first arm 32 is slidably received within a third tubular arm 36. The distal end 39 of the second tubular arm 34 is slidably received within a fourth tubular arm 38.

FIG. 2A shows the handle portion 100 releasably secured with first and second detent pins 44, 46 in a fully extended position.

FIG. 2B shows the handle portion 100 releasably secured with the first and second detent pins 44 in a partially extended position.

FIG. 2C shows the handle portion 100 releasably secured with the first and second detent pins 44 in a fully retracted position.

Figure 6:
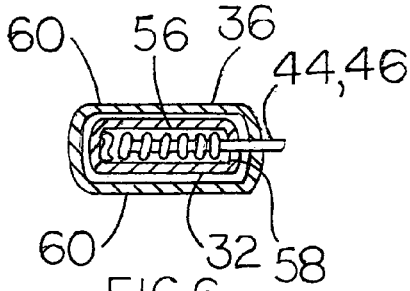
FIG. 6 is a cross sectional view the extendable arms secured with a detent pin extending through a detent aperture.

The extendable handle frame 400 comprises a first tubular frame member 52, which is positioned to receive the third tubular arm 36 therein, as shown in FIG. 6. Likewise the second tubular frame member 54 is positioned in spaced, parallel alignment from the first tubular member 52, and positioned to receive the fourth tubular arm 38 therein. The tubular frame members 36, 38, 52, 54 are preferably square tubular members, although it is within the scope of this disclosure to provide round or multi-sided tubular members, in place of the square tubular members.

An upper frame cross brace 62 extends between the upper portion of the first and second tubular frame members 52, 54. Likewise a lower frame cross brace 64 extends between the lower portion of the first and second tubular frame members 52, 54, providing a rigid frame structure 400 therebetween.

The upper frame cross brace 62 includes a first catch member 66 having a depending portion 68 extending in spaced relation from the upper cross brace 62. The first catch member 66 includes a slot 70 centrally disposed thereon.

Figure 5:
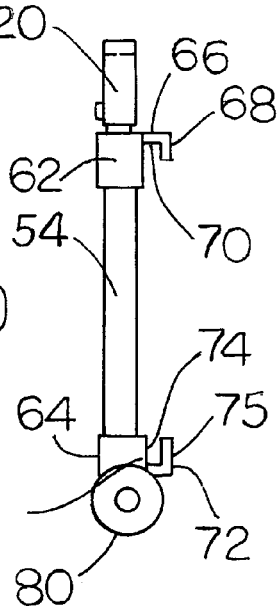
FIG. 5 is a side elevational view of the frame portion, showing the upper and lower mounting arm portions, positioned for securement to the mounting brackets.

The lower frame cross brace 64 includes a second catch member 72 extending upwardly in spaced relation from the lower frame cross brace 64 towards the first catch member 66, as shown in FIG. 5. The second catch member 72 also has a slot 74 centrally disposed thereon.

The lower frame cross brace 64 also has an axle 76 extending through aligned axle apertures 78. Wheels 80 are rotatably secured near the opposing ends of the axle 76. The aligned axle apertures 78 are located below the second catch member 72. The axle 76 may be a single rod-like member, or can be formed as two separate aligned rod-like members, to suit manufacturing preference.

The second catch member 72 is biased upwardly by at least one catch biasing means 82, such as a spring. The second catch member 72 includes a releasable catch latch 84, which when depressed, allows the second catch member 72 to be depressed. When the releasable catch latch 84 is not depressed, the catch biasing means 82 extends the second catch member 72, and the releasable catch latch 84 locks the second catch member 72 in a raised latching position.

Figure 3:
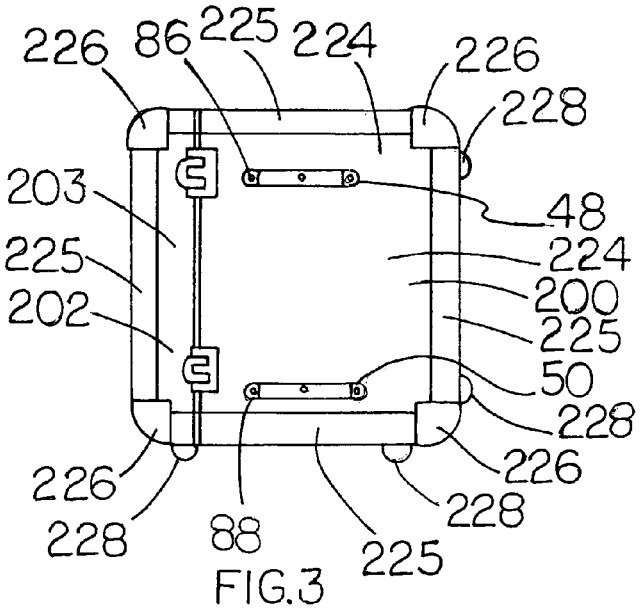
FIG. 3 is a rear elevational view of a record case, showing two spaced mounting brackets secured to the back side of the record case.

FIG. 3 is a rear view of the record case housing 200 with lid 202 attached, showing the extendable handle portion 100 removed from the upper and lower mounting brackets 48, 50 secured to the housing 200. This is important where space is at a premium. As shown in FIG. 3, two mounting brackets 86, 88 are secured in spaced, parallel relation to the record case portion 200. The mounting brackets 86, 88 are secured to the record case 200 by any known securement means, such as rivets, screws, etc. The mounting brackets 86, 88 are spaced apart and positioned to engage the first and second catch members 66, 72 of the frame 400 when the catch member 84 on the frame 400 is depressed. Once positioned upon the mounting brackets 86, 88, the catch member 84 is released, which raises the lower catch latch to releasably secure the frame 400 onto the mounting brackets 86, 88. Thus, the frame 400 may be releasably secured to selectively mount and dismount the frame 400 from the mounting brackets 86, 88, to suit the users needs.

Figure 4:
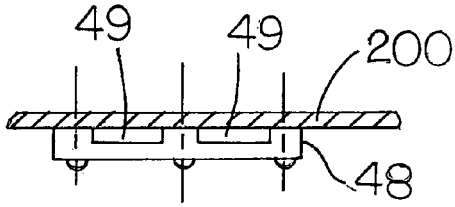
FIG. 4 is a partial top view of the rolling record case of FIG. 1, showing the general shape of the mounting brackets.

FIG. 4 is a partial top view of the upper mounting bracket 48, showing one or more openings 49 sized to receive the depending portion 68 of the upper frame cross brace 48. As shown in FIG. 4, two openings 49 are provided.

Figure 7:
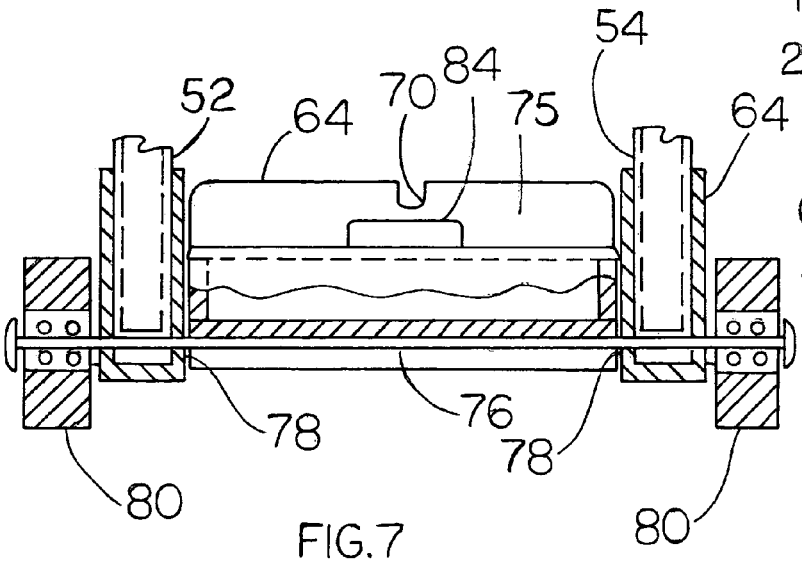
FIG. 7 is a front view of the lower frame cross brace, showing the wheels attached to the lower frame cross brace with an axle, and a releasable catch latch, which when depressed releases the catch latch from engaging with the lower mounting bracket.

As shown in FIG. 7, the frame 400 supports rotatable wheels 80 and the extendable handle portion 100. Thus, the wheels 80 and the extendable handle portion 100 are removable from the record case 200 when the frame 400 is removed from engagement with the mounting brackets 48, 50. Also see FIG. 15 and FIG. 17.

Alternately, each wheel 80 may be independently secured to the rolling record case apparatus 300. Where the wheel 80 is independently secured, a wheel recess 81 is preferably provided to partially receive the wheel 80 therein. See FIG. 11, FIG. 14A, FIG. 14B, and FIG. 16.

Figure 8A:
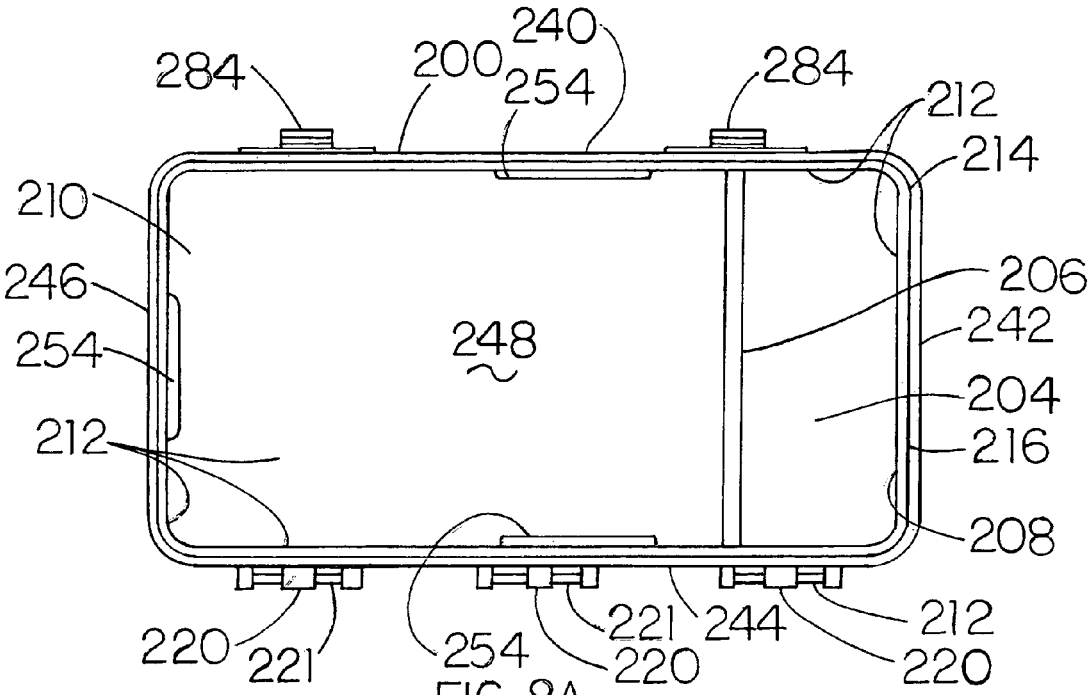
FIG. 8A is a top elevational view of one embodiment of a record case portion with the lid removed, showing compartments formed therein.

FIG. 8A is a top view of the record case housing 200 with the lid 202 removed. The record case housing 200 has a front side 240, a left side 242, a back side 244, a right side 246, a bottom side 248, and an open top side 250. Preferably, the record case housing 200 has a carrying handle 232 located on left and right sides 242, 246 of the record case housing 200.

Figure 8B:
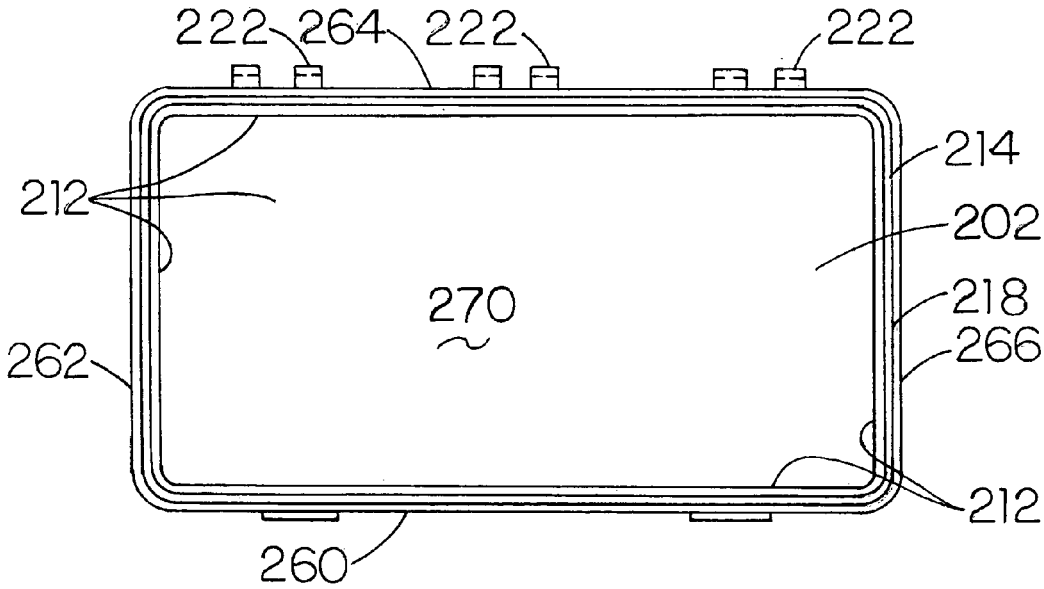
FIG. 8B is a bottom view of the lid, prior to attachment to the record case.
Figures 11, 12, 13:
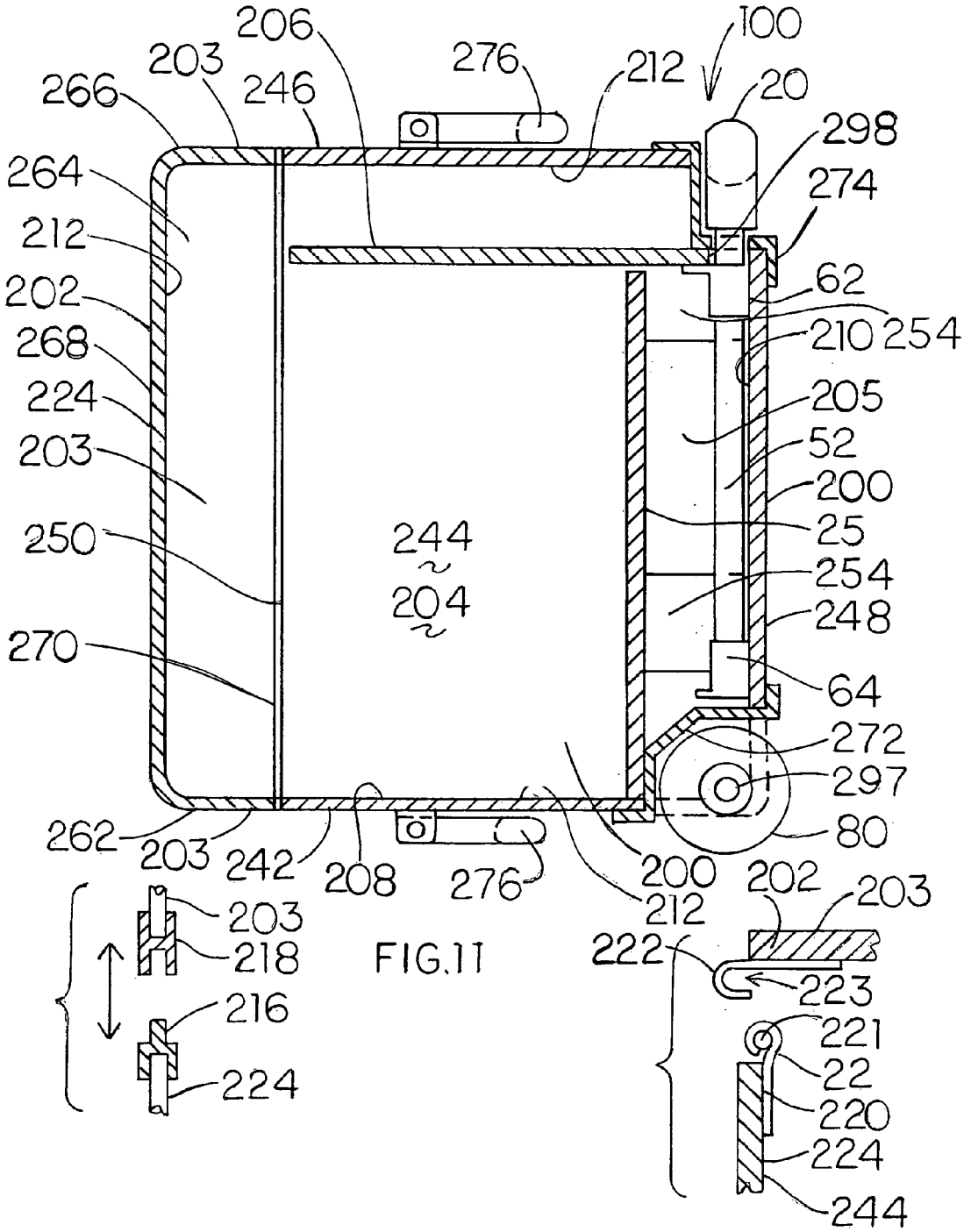
FIG. 11 is a cross-sectional view of the record case with the extendable handle and wheels located within the container.
FIG. 12 is a cross-sectional view of the raised lip and recess joining the outer periphery of the rolling record case to the outer periphery of the lid.
FIG. 13 is a hinge detail showing the removable hinge with the slot on the second hinge portion rotated for insertion on the pin located on the first hinge portion.

The removable lid 202, shown in FIG. 8B has a front side 260, a left side 262, a back side 264, a right side 266, a top side 268 and an open bottom side 270. The removable lid 202 has a second hinge portion 222 with a slot 223 which is sized to engage the pin 221 located on the first hinge portion 220, as best shown in FIG. 13. When engaged, the lid 202 pivots about pin 221 into a closed position. When pivoted into a raised position, the lid 202 may be easily removed by sliding the slot 223 away from the pin 221.

FIG. 5 is a side view of the frame portion 400 of the extendable handle 100, showing the first catch member 66 having a depending portion 68, and the second catch member 72, having a raised portion 75 which is engagable within the opening(s) 49 in the lower mounting bracket 50.

As shown in cross section in FIG. 6, the first, second, third and fourth tubular arms 32, 34, 36, 38 and first and second tubular frame members 52, 54 preferably have at least two parallel sides 60, which serve to resist rotation of the first tubular arm 32 in the third tubular arm 36, and the second tubular arm 34 in the fourth tubular arm 38.

A first detent pin 44 selectively limits travel of the first tubular arm 32 within the third tubular arm 36. Likewise, a second detent pin 46 selectively limits travel of the second tubular arm 34 within the fourth tubular arm 38. The first detent pin 44 also selectively limits travel of the third tubular arm 36 within the first tubular frame member 52. Likewise, the second detent pin 46 selectively limits travel of the fourth tubular arm 38 within a second tubular frame member 54. The second detent pin 46 also selectively limits travel of the second tubular arm 34 within the fourth tubular arm 38.

The first and second detent pins 44, 46, are extendably biased by a biasing means 56, such as a spring, which biases the first and second detent pins 44, 46 into aligned apertures 58 provided in the lower portion of the first and second tubular frame members 52, 54, in the lower portion of the third and fourth tubular arms 36, 38, in the upper portion of the third and fourth tubular arms 36, 38, and in the lower portion of the first and second tubular arms 32, 34.

When aligned, the first and second detent pins 44, 46 extend through apertures 58 to releasably secure the respective arms 32, 34, 36, 38 in a first, second or third releasable locking position 24, 26, 28. The releasable latch 22 located in the hand grip portion 20, is depressed to retract the detent pins 44, 46 from said apertures 58, allowing the handle arms to be further extended or retracted, as desired. Any known means for biasing the detent pins 44, 46 between extended and retracted positions may be used, without departing from the scope of this disclosure, or from the following claims.

FIG. 8A is a top elevational view of the record case 200 with the lid 202 removed, showing at least one compartment 204 formed therein. Preferably, the compartment 204 is divided into more than one compartment by one or more dividing walls 206. At least one compartment 204 is sized to slidably receive and store vinyl records 280 therein. The opposing ends of the vinyl records 280 are slidably received in said compartment 204, to protect the vinyl records 280 from damage from shifting during transport. The interior sides 208 and bottom surface 210 of the record case 200 are preferably coated with a resilient material 212, such as a foam sheet, or suitable fabric, etc, to protect the vinyl records 280 from damage during transport or storage.

Figure 14A:
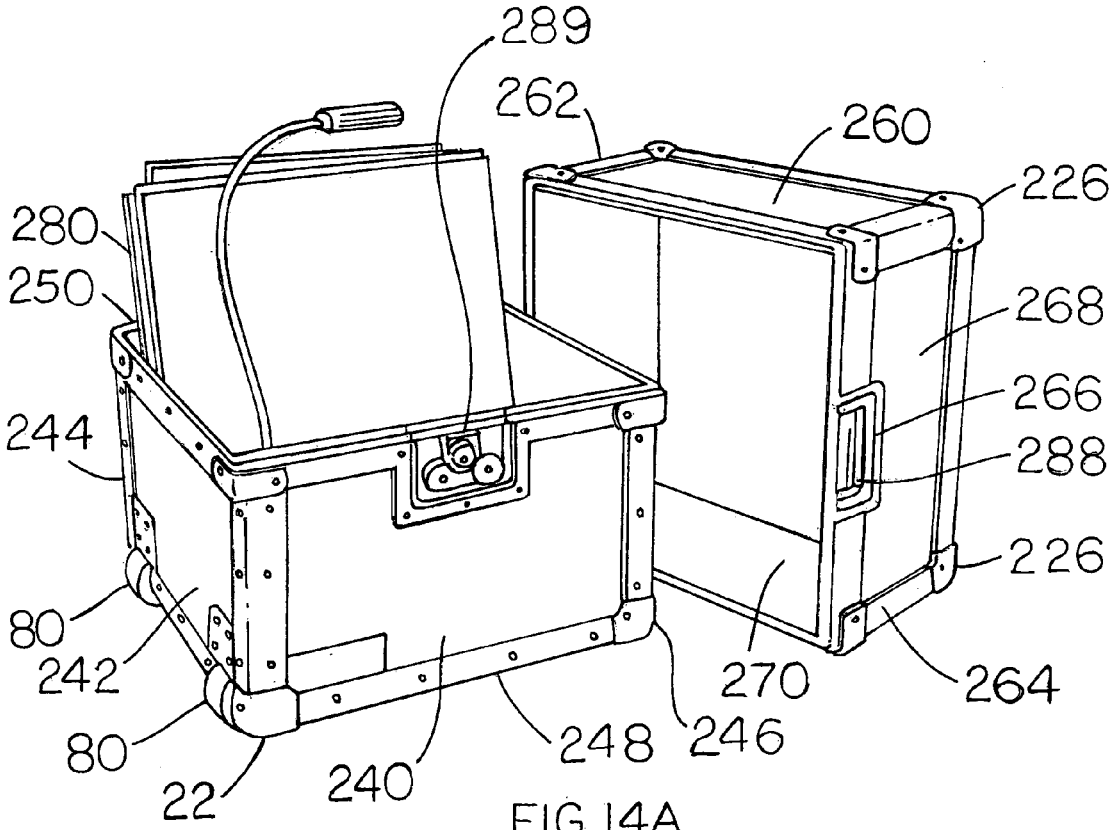
FIG. 14A is a perspective view of the record case showing two wheels mounted directly to the bottom portion of the record case, with the lid set to one side.
Figure 17:
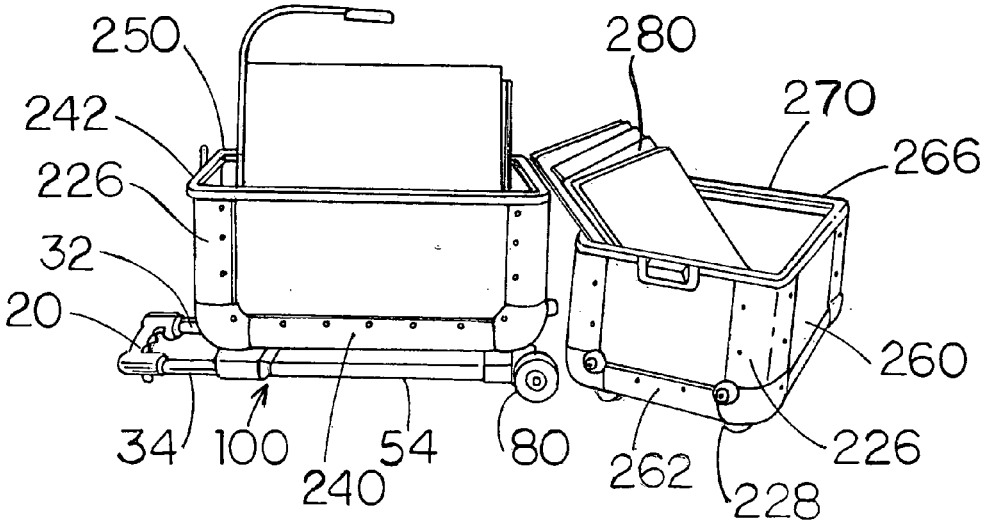
FIG. 17 is a perspective view of the rolling record case, with the lid portion removed from the record case housing, and both the lid and the record case are used to store vinyl records therein.

As shown in FIGS. 14A and 17, the compartment 204 formed in the case 200 may further comprise means for illuminating the compartment. In one embodiment, the compartment 204 further comprises a light 500 configured for illuminating the interior of the compartment 204. In other embodiments, the light 500 comprises a generally flexible stem 510 configured to carry electrical connections (not shown) from a power source (not shown) provided in the case 200, such as one or more batteries, to a lamp member 520. Lamp member 520 may comprise any common lamp, such as a desk lamp, having an illumination source 530, such as a light bulb, sufficient for lighting the interior of the compartment 204. An example of use of light 500 during use of the case 200 is for a disk jockey utilizing the case 200 in a low light setting to illuminate the interior of the compartment 204 in order to view, for example, records 280 stored therein.

A raised lip 216 preferably extends about the outer periphery 214 of the open topped compartment 204, as shown in FIG. 12. A complimentary recess 218 in the outer periphery 214 of the lid 202 is sized to receive the raised lip 216 therein, providing increased strength and improved integrity to the contents of the record case 200. Of course, the raised lip 216 may alternately be located on the outer periphery of the lid 202, and the complimentary recess may be located on the outer periphery of the open topped compartment 204, without departing from the scope of this disclosure, or the following claims.

As shown in FIG. 13, the lid 202 is preferably rotated upon at two or more first hinge portions 220, each having at least one pin 221 secured on back side 244 near the top of the compartment 204 on the record case 200. A complimentary second hinge portion 222 is aligned with the first hinge portion 220 on the depending side of the lid 202. The second hinge portion 222 has at least one U-shaped portion sized to pivot about the pin 221 on the first hinge portion 220. Once the lid 202 is raised at least 90 degrees, the U-shaped portion 203 on the second hinge portion 222 may be slidably removed from the pin 221 on the first hinge portion 220, enabling the lid 202 to be entirely removed for improved access to the record case compartment 204. Preferably, there are from two to four first hinge portions 220, and two to four complimentary second hinge portions 222 aligned to engage the first hinge portions 220 when the lid 202 is closed about the record case housing 200.

A carrying handle 230 shown in FIG. 1A and FIG. 1B, is preferably pivotally secured to the lid 202, for ease of carrying the record case 200, when the frame has been removed from the record case housing 200. The handle 230 is preferably offset on the lid 202 to balance the load of the vinyl records 280 stored within. This is particularly important, where the compartment 204 is partitioned with dividing walls 206, and the vinyl records 280 are stored in only one side or end of the record case 200.

Figure 14B:
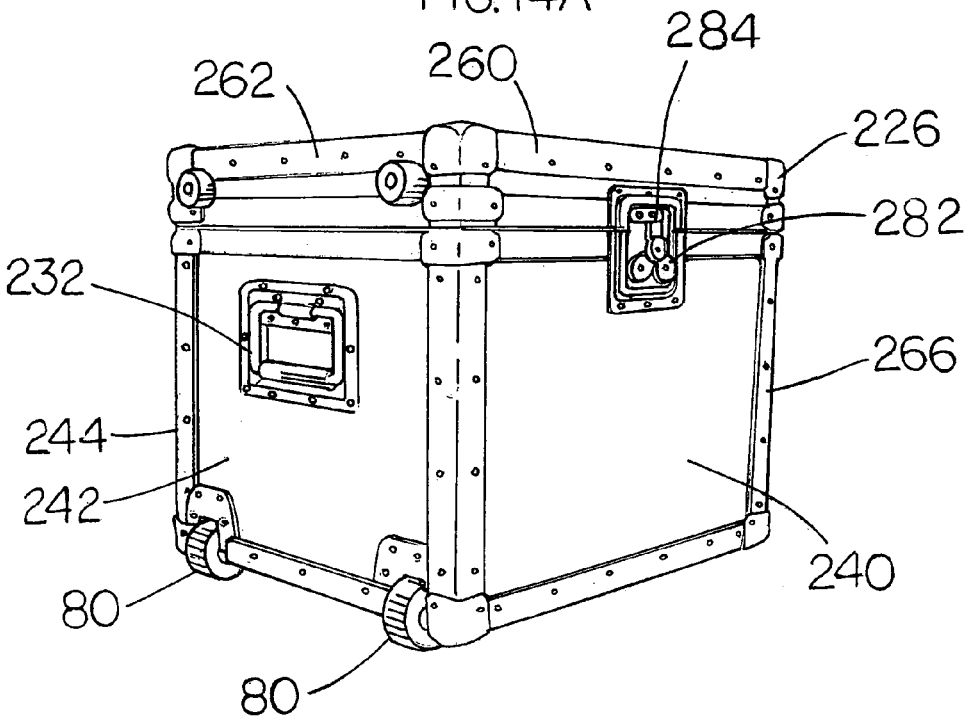
FIG. 14B is a perspective view of the record case of FIG. 14A, showing two permanently attached wheels secured to the bottom portion of the record case.
Figure 15:
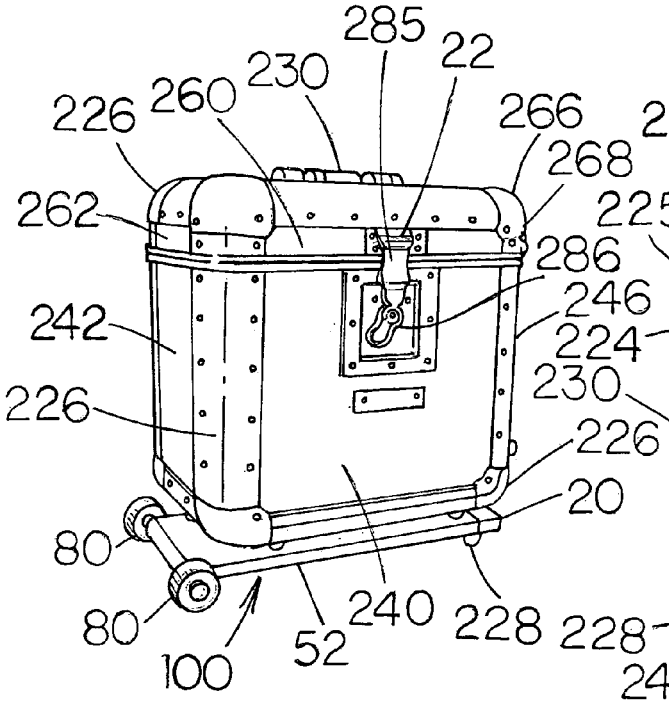
FIG. 15 is a perspective view of the rolling record case with two wheels attached to a removable frame member. The rolling record case is shown with the lid attached to the record case housing.
Figure 16:
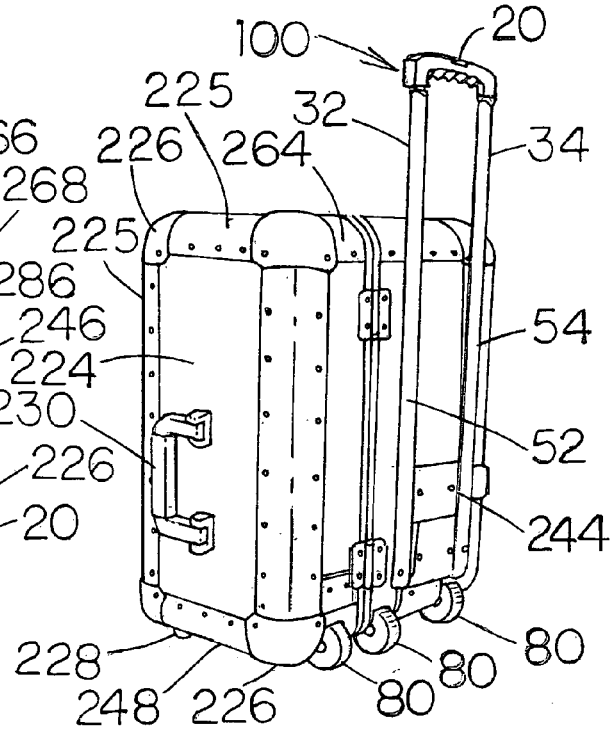
FIG. 16 is a perspective view of the rolling record case, with two wheels permanently attached to the record case housing, and one additional wheel permanently attached to the lid portion, in axial alignment with the two wheels on the record case housing. The lid is attached to the record case housing, and the handle portion is positioned at the first intermediate handle position.

The outer surface 224 of the record case 200 is preferably coated with a sheet of scratch and dent resistant material, such as aluminum or other suitable metal. Preferably, the metal is polished, buffed, burnished, or otherwise decorated, to provide an attractive appearance. The exposed sides 225 and corners 226 of the record case 200 are preferably rounded, and covered with reinforcing material, to protect the contents of the record case 200 during transport, and to improve the looks of the record case 200, during use, as shown in FIG. 15, FIG. 16 and FIG. 17. Alternately, the exposed sides 225 and corners 226 may be square sides, as shown in FIGS. 14A and 14B.

One side or end of the record case 200 preferably has feet 228, which extend from the outer surface 224 to support the record case 200 in an upright position. Two feet 228 are preferably secured on one depending side 203 of the lid, while two feet 228 are secured on a complimentary side of the outer surface 224 of the record case 200. This enables the record case to stand on end, when not in use, as shown in FIG. 1A and FIG. 1B. The feet 228 are preferably located on a side adjacent to the side on which the lower mounting bracket 50 is located. In this way, the record case 200 may stand on end, with the extendable handle 100 positioned to extend upright when needed, as shown in FIG. 16.

Figures 9, 10A, 10B:
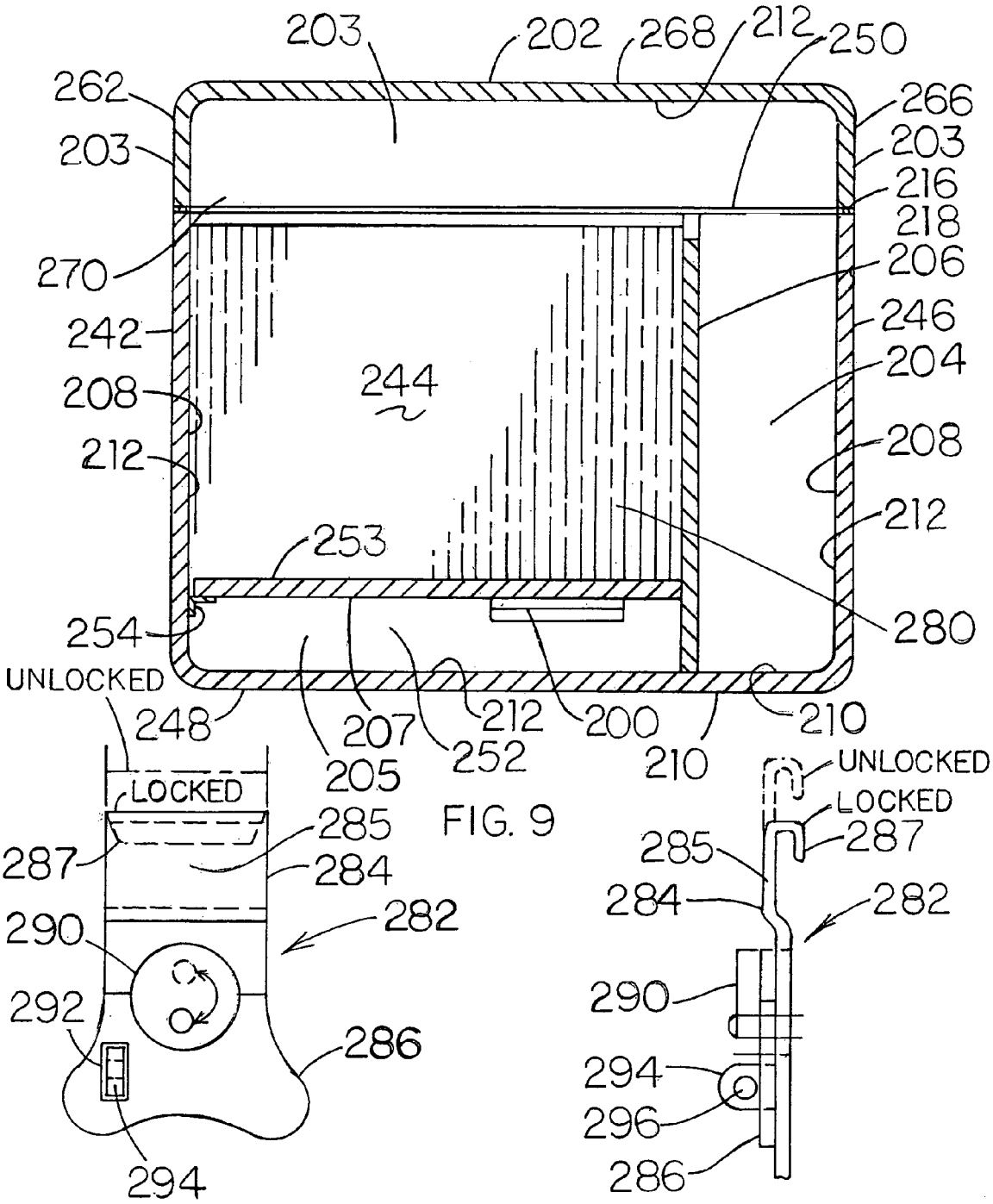
FIG. 9 is a cross sectional view of the record case shown in FIG. 8, showing a hidden compartment located beneath a false bottom.
FIG. 10A is a detail view of the rotatable handle mechanism for biasing the latch mechanism between latched and unlatched positions.
FIG. 10B is a side view of the rotatable handle mechanism shown in FIG. 10A, showing the lock tab aperture.

As best shown in FIG. 9 and FIG. 11, a hidden compartment 205 having a removable cover 207 is preferably located between the bottom side 248 and a false bottom support 252 positioned in spaced relation above the bottom side 248. The false bottom support 252 has a removable cover 253 which is supported above the bottom side 248 on the raised bottom support member 254, in a manner known to those skilled in the art of forming hidden compartments and in the luggage arts.

Referring now to FIG. 10A and FIG. 10B, the latch portion 282 preferably includes a slideable latch member 284, with a hook portion 285 located on the distal end 287. A lock handle 286 is rotatably positioned to bias the latch member 284 between open and closed positions about cam member 290. The slidable latch member 284 is engagable with a complimentary catch member 288 secured to a complimentary depending side of the lid 202. The complimentary catch member 288 has a lip 289 positioned to engage the hook portion 285 of the latch portion 282. The rotating lock handle 286 is preferably pivotable between open and closed positions. In the open position, the lock handle 286 is rotatable to bias the latch member 284 between engaged and unengaged latch positions. The lock handle 286 is lockable when rotated into the latched position, and pivoted into the closed position, as shown in FIG. 10B. The rotating lock handle 286 preferably has an aperture 292 sized to receive a projecting lock tab 294. The projecting lock tab 294 preferably has a lock aperture 296 therein for receiving the shank of a lock 290, so that the rotating handle 286 can be locked in its closed, folded flat configuration, when rotated into its latched position.

FIG. 11 is cross sectional view of an alternate embodiment of the rolling record case 200, in which the frame 400 supporting the extendable handle portion 100 is secured within the record compartment 204 to one of the interior sides 208. In this embodiment, the wheels 80 are separately secured to the record case 200 to extend through wheel apertures 297, as shown in FIG. 11. The hand grip portion 20 partially extends through a handle aperture 298 in the record case 200. In this embodiment, operation of the extendible handle portion 100, between extended, intermediate and retracted positions is the same as disclosed above.

FIG. 12 is an exploded cross-sectional view of the raised lip 216 located about the outer periphery 214 of the record case housing 200. A complimentary recess 218 is located about the outer periphery 214 of the lid 202. When the lid 202 is closed upon the record case housing 200, the raised lip 216 is slidably received within the complimentary recess 218. This provides a secure fit between the record case housing 200 and the lid 202. Of course, the raised lip 216 may be placed about the outer periphery of the lid 202, and the complimentary recess 218 is placed about the outer periphery of the record case housing 200, without departing from the scope of this disclosure, or from the following claims.

The invention being thus described, it will be evident that the same may be varied in many ways. Such variations are not to be regarded as a departure from the spirit and scope of the invention and all such modifications are intended to be included within the scope of the claims.

PARTS LIST

100 extendable handle portion
200 record case housing
300 rolling record case apparatus
400 frame portion
20 hand grip portion
22 releasable handle latch
24 first intermediate handle position
26 second fully extended handle position
28 third fully retracted handle position
32 first tubular arm
34 second tubular arm
36 third tubular arm
37 distal end of first tubular arm
38 fourth tubular arm
39 distal end of second tubular arm
40 handle end
42 frame end
44 first detent pin
46 second detent pin
48 upper mounting bracket
49 opening(s)
50 lower mounting bracket
52 first tubular frame member
54 second tubular frame member
56 biasing means
58 aperture
60 parallel sides
62 upper frame cross brace
64 lower frame cross brace
66 first catch member
68 depending portion

70 centrally disposed slot
72 second catch member
74 second slot
75 raised portion
76 axle
78 aligned axle apertures
80 wheel
81 wheel recess
82 catch biasing means
84 catch member
86 first mounting bracket
88 second mounting bracket
202 lid
203 depending side(s)
204 compartment
205 hidden compartment
206 dividing wall(s)
207 removable cover
208 interior sides
210 bottom surface
212 resilient material
214 outer periphery
216 raised lip
218 complimentary recess
220 first hinge portion
221 pin
222 second hinge portion
223 slot
224 outer surface
225 exposed sides
226 corners
228 feet
230 lid carrying handle
232 compartment handle
240 compartment front side
242 compartment left side
244 compartment back side
246 compartment right side
248 compartment bottom side
250 compartment open top side
252 compartment false bottom support
253 removable cover
254 raised support member
260 lid front side
262 lid left side
264 lid back side
266 lid right side
268 lid top side
270 lid open bottom side
280 vinyl records
282 latch portion
284 slidable latch member
285 hook portion
286 lock handle
287 distal end of latch
288 complimentary catch member
289 catch member lip
290 cam member
292 handle aperture
294 lock tab
296 lock tab aperture
297 wheel aperture
298 handle aperture

What is claimed is:

1. A rolling record case with an extendable handle, comprising:

a) a record case sized to receive a plurality of records therein, the record case having a bottom portion, a front portion, a left side portion, a back portion, and a right side portion forming an open top compartmented interior therebetween;

b) a lid with a top portion, a depending front portion sized to engage the front portion of the record case, a depending left side portion sized to engage the left side portion of the record case, a depending rear portion sized to engage the rear portion of the record case; and a depending right side portion sized to engage the right side portion of the record case, said lid sized to be releasably and pivotally secured to the record case to selectively secure a plurality of records therein;

c) a frame portion, sized to be selectively mounted and releasably secured to one of the left side portion, the back portion, the right side portion and the bottom portion of the record case, the frame portion having a first side, a second side spaced from said first side, a wheel mounting end with an axle support extending between the first side and the second side of the frame portion near the wheel end, and a handle mounting end with a handle support extending between the first side and the second side of the frame portion near the handle end, d) an extendable handle having a first handle portion and a second handle portion at a first retracted position adjacent to the handle end of the frame portion and extending from the first and second frame portions, a second partially extended handle position with the first and second handle portions extending from the handle end of the first and second frame portions, and a third fully extended handle position with the third and fourth handle portions extending from the first and second handle portions, the distal end of the third and fourth handle portions with a grasping handle extending between the third and fourth handle portions;

e) a securing latch means and a securing catch means for releasably securing the lid to the record case; and f) one or more visible compartments located within the record case, with one or more hidden compartments located beneath a false bottom panel, the false bottom panel supported in spaced relation above the bottom portion of the record case by spaced false bottom supports, said frame portion being releasably secured to said record case between an upper mounting bracket secured to said record case and a spaced apart lower mounting bracket secured to said record case, said frame portion having an upper frame cross-brace and a spaced apart lower frame cross-brace, said upper and lower mounting brackets and said upper and lower frame cross-braces being engageable to removably secure said frame portion to said record case, said upper frame cross brace including a first catch member having a first depending portion extending generally downwardly in spaced relation from said upper frame cross brace, said lower frame cross brace including a second catch member having a second depending portion extending generally upwardly in spaced relation from said lower frame cross brace generally toward said first catch member, said second upper and lower mounting brackets being configured to releasably engage said first and second catch members, respectively, said upper and lower mounting brackets each comprising a pair of openings separated by a middle portion, each of said first and second catch members comprising a slot generally centrally disposed on said first and second depending portions, said depending portions being received in said openings, said middle portions being received in said slots.

2. The rolling record case of claim 1, wherein at least two feet are positioned in spaced relation from said axle support, to stabilize the bottom portion of the record case in a substantially horizontal position when the record case is at rest upon said feet and said axle support.

3. The rolling record case of claim 1, wherein a carrying handle is pivotally secured to the lid, for ease of carrying the record case when the when the frame has been removed from the record case housing, and the carrying handle is offset on the hinged lid to balance the load of the plurality of records stored within.

4. The rolling record case of claim 1, wherein the outer surface of the record case is covered with a sheet of scratch and dent resistant material, and the scratch resistant material is treated to provide an attractive appearance.

5. The rolling record case of claim 1, wherein the exposed corners of the record case are rounded and covered with a reinforcing material, to protect the contents of the record case during transport, storage and use.

6. The rolling record case of claim 1, wherein the lower surface of the hand grip portion is molded to conform to the grip of a user's fingers as the user grasps the hand grip.

7. The rolling record case of claim 1 wherein a release catch is located upon said gripping handle to manually bias said gripping handle between a retracted handle position for shipping and storage, an intermediate handle position for carrying the record case over curbs and up and down stairs and for traversing over other obstacles, and a fully extended handle position for ease of pulling or pushing the record case over pavement, sidewalks and floors.

8. The rolling record case of claim 1, wherein a first detent pin in the first handle portion is positioned to selectively engage a complimentary aperture in the third handle portion, and a second detent pin in the second handle portion is positioned to selectively engage a complimentary aperture in the fourth handle portion, to releasably secure the third and fourth handle portions in relation to the first and second handle portions, when said first, second, third and fourth handle portions are selectively positioned in one of a retracted position, a partially extended position and a fully extended position.

9. The rolling record case of claim 8 wherein said grasping handle has a handle latch thereon, said handle latch being operatively connected to said detent pins.

10. A rolling record case of claim 1, wherein the frame portion is mounted to one of the front side, the left side, the back side and the right side within the record case, and each of the wheels extend through a respective aperture in the record case to engage the ground when the extendable handle portion is extended for use.

11. The rolling record case of claim 1 wherein said lid is both pivotally and releasably secured to the record case.

12. The rolling record case of claim 1 wherein said compartmented interior is compartmented to hold vinyl records, compact disks, DVDs, and combinations thereof.

13. The rolling record case of claim 1 wherein said lid when removed may be used to store vinyl records, compact disks, DVDs, and combinations thereof and to segregate the same from those stored in said compartmented interior.

14. The rolling record case of claim 1 wherein said lid is hingedly secured to one of said right and left side portions of said record case and secured to said record case by a clasp at the other of said side portions of said record case.

15. The rolling record case of claim 1 wherein said lid is secured to said record case by a pair of clasps which are secured to opposite portions of said record case chosen from the group of portions consisting of said front portion, said left side portion, said right side portion, and said back portion.

16. The rolling record case of claim 1 wherein said compartmented interior further comprises a light, said light illuminating said compartmented interior when lit.

17. The rolling record case of claim 1 wherein said frame portion is secured to said bottom portion, and further comprising a carrying handle pivotally secured to said top portion for ease of carrying the record case when said frame has been removed from the record case, said carrying handle being offset on said top portion to balance the load of the plurality of records stored within said carrying case.

18. The rolling record case of claim 1 wherein said frame portion is secured to said bottom portion, and further comprising a carrying handle pivotally secured to one of said side portions for ease of carrying the record case when the frame has been removed from the record case, said carrying handle being offset on said one side portion to balance the plurality of records stored therein.

19. The rolling record case of claim 1 wherein said frame portion is secured to said bottom portion, and further comprising a pair of carrying handles pivotally secured to said side portions respectively for ease of carrying the record case when the frame portion has been removed from the record case, said carrying handles being offset on said side portions to balance the load of the plurality of records stored therein.

20. The rolling record case of claim 1 wherein said latch means comprises a hook portion on a distal end of a slidable latch portion, and a lock handle assembly positioned to bias said latch portion between an opened and a closed position.

21. The rolling record case of claim 20 wherein said lid is secured to said record case by a catch member for selectively engaging said hook portion of said slidable latch portion.

22. The rolling record case of claim 1 wherein said handle portions are telescoping square tubular members.

23. The rolling record case of claim 1 wherein an axle extends through said axle support of said frame portion adjacent said wheel end, wheels on said axle, said axle being beneath said lower mounting bracket.

24. The rolling record case of claim 1 wherein said second catch member is biased generally upwardly by at least one catch biasing means comprising a releasable catch latch configured to allow said second catch member to be depressed and engaged or disengaged from said lower mounting bracket.

25. The rolling record case of claim 24 wherein said catch biasing means comprises a spring configured to biasedly extend said second catch member generally upwardly.

26. The rolling record case of claim 1 wherein each of said compartmented interior and said lid are configured to receive one or more of records, CDs DVDs, and combinations thereof.

27. A rolling record case with an extendable handle, comprising:

a) a record case sized to receive a plurality of records therein, the record case having a bottom portion, a front portion, a left side portion, a back portion, a right side portion, and an open top portion with a raised lip extending about the outer periphery of the open top portion, the record case forming a compartmented interior therebetween;

b) a removable lid with a top portion, a depending front portion, a depending left side portion, a depending rear portion; a depending right side portion, and an open bottom portion, said lid with a complimentary recess extending about the outer periphery of the open bottom portion in complimentary alignment with the raised lip on the record case;

c) a frame portion, sized to be selectively mounted and releasably secured to one of the left side portion, the back portion, the right side portion and the bottom portion of the record case, the frame portion having a first side, a second side spaced from said first side, a wheel mounting end with an axle support extending between the first side and the second side of the frame portion near the wheel end, and a handle mounting end with a handle support extending between the first side and the second side of the frame portion near the handle end, d) an extendable handle having a first handle portion and a second handle portion at a first retracted position adjacent to the handle end of the frame portion and extending from first and second frame portions, a second partially extended handle position with the first and second handle portions extending from the handle end of the first and second frame portions, and a third fully extended handle position with third and fourth handle portions extending from the first and second handle portions, the distal end of the third and fourth handle portion with a grasping handle having a hand grip portion extending between the third and fourth handle portions, the handle having a release catch located upon the hand grip portion, and the release catch is depressed to enable the user to manually bias the hand grip portion between a retracted handle position for shipping and storage, and intermediate handle position for carrying the record case over curbs and up and down stairs and while traversing over obstacles, and a fully extended handle position for ease of pulling or pushing the record case over pavement, sidewalks and floors;

e) at least two feet positioned in spaced relation from the wheels, to stabilize the bottom portion of the record case in a substantially horizontal position when the record case is positioned to rest on the wheels and on the feet;

f) a securing latch means and a complimentary securing catch means from releasably securing the lid to the record case;

g) a carrying handle pivotally secured to the lid, for ease of carrying the record case when the frame has been removed from the record case housing, and the carrying handle is offset on the lid to balance the load of the plurality of records stored within;

h) one or more visible compartments located within the record case, with one or more hidden compartments located beneath a false bottom panel, the false bottom panel being supported in spaced relation above the bottom portion of the record case by spaced false bottom supports, said frame portion being releasably secured to said record case between an upper mounting bracket secured to said record case and a spaced apart lower mounting bracket secured to said record case, said frame portion having an upper frame cross-brace and a spaced apart lower frame cross-brace, said upper and lower mounting brackets and said upper and lower frame cross-braces being engageable to removably secure said frame portion to said record case, said upper frame cross brace including a first catch member having a first depending portion extending generally downwardly in spaced relation from said upper frame cross brace, said lower frame cross brace including a second catch member having a second depending portion extending generally upwardly in spaced relation from said lower frame cross brace generally toward said first catch member, said second upper and lower mounting brackets being configured to releasably engage said first and second catch members, respectively, said upper and lower mounting brackets each comprising a pair of openings separated by a middle portion, each of said first and second catch members comprising a slot generally centrally disposed on said first and second depending portions, said depending portions being received in said openings, said middle portions being received in said slots.

28. The rolling record case of claim 27, wherein the outer surface of the record case is covered with a sheet of scratch and dent resistant material, and the scratch resistant material is treated to provide an attractive appearance.

29. The rolling record case of claim 27, wherein the exposed corners of the record case are covered with a right angle reinforcing material, to protect the corners of the record case during transport, storage, and use.

30. The rolling record case of claim 27, wherein the lower surface of the hand grip portion is molded to conform to the grip of a user's fingers as the user grasps the hand grip.

31. The rolling record case of claim 27, wherein a first detent pin in the first handle portion is positioned to selectively engage a complimentary aperture in the third handle portion, and a second detent pin in the second handle portion is positioned to selectively engage a complimentary aperture in the fourth handle portion, to releasably secure the third and forth handle portions in relation to the first and second handle portions, and said first, second, third and fourth handle portions are selectively positioned in one of a retracted position, a partially extended position and a fully extended position.

32. A rolling record case of claim 27, wherein the frame portion is mounted to one of the front side, the left side, the back side and the right side within the record case, and each of the wheels extend through a respective aperture in the record case to engage the ground when the extendable handle portion is extended for use.

33. The rolling record case of claim 27 wherein said lid is both releasable and pivotally secured to said record case.

34. The rolling record case of claim 27 wherein each of said compartmented interior and said lid are configured to receive one or more of records, CDs DVDs, and combinations thereof.

35. A rolling record case with an extendable handle, comprising;

a) a record case sized to receive a plurality of records therein, the record case having a bottom portion, a front portion, a left side portion, a back portion, a right side portion, and an open top portion forming a compartmented interior therebetween, the open top portion with a raised lip extending about an outer periphery of the open top portion;

b) a lid with a top portion, a depending front portion, a depending left side portion, a depending rear portion case; and a depending right side portion, said lid with a complimentary recess sized to receive the raised lip about the outer periphery of the record case;

c) a frame portion, sized to be selectively mounted and releasably secured to one of the left side portion, the back portion, the right side portion and the bottom portion of the record case, the frame portion having a first side, a second side spaced from said first side, a wheel mounting end with an axle support extending between the first side and the second side of the frame portion near the wheel end, and a handle mounting end with a handle support extending between the first side and the second side of the frame portion near the handle end;

d) a first detent pin in the first handle portion is positioned to selectively engage a complimentary aperture in the third handle portion, and a second detent pin in the second handle portion is positioned to selectively engage a complimentary aperture in the fourth handle portion, to releasably secure the third and forth handle portions in relation to the respective first and second handle portions, and said first, second, third and fourth handle portions are selectively positioned in one of a retracted position, a partially extended position and a fully extended position;

e) an extendable handle having a first handle portion and a second handle portion at a first retracted position adjacent to the handle end of the frame portion and extending from the first and second frame portions, a second partially extended handle position with the first and second handle portions extending from the handle end of the first and second frame portions, and a third fully extended handle position with third and fourth handle portions extending from the first and second handle portions, the distal end of the third and fourth handle portions with a grasping handle extending between the third and fourth handle portions, the handle having release catch located upon the hand grip portion, and the release catch is depressed to enable the user to manually bias the hand grip portion between a retracted handle position for shipping and storage, an intermediate handle position for carrying the record case over curbs and up and down stairs and while traversing over obstacles, and a fully extended handle position for ease of pulling or pushing the record case over pavement, sidewalks and floors;

f) at least two feet positioned in spaced relation from the wheels, to stabilize the record case in a substantially horizontal position when the record case is positioned to rest on the wheels and on the feet;

g) a securing latch means and a securing catch means for releasably securing the lid to the record case;

h) a carrying handle pivotally secured to the lid, for ease of carrying the record case when the frame has been removed from the record case housing, and the carrying handle is offset on the lid to balance the load of the plurality of records stored within;

i) one or more visible compartments located with the record case, with one or more hidden compartments located beneath a false bottom panel, the false bottom panel being supported in spaced relation above the bottom portion of the record case by spaced false bottom supports, said frame portion being releasably secured to said record case between an upper mounting bracket secured to said record case and a spaced apart lower mounting bracket secured to said record case, said frame portion having an upper frame cross-brace and a spaced apart lower frame cross-brace, said upper and lower mounting brackets and said upper and lower frame cross-braces being engageable to removably secure said frame portion to said record case, said upper frame cross brace including a first catch member having a first depending portion extending generally downwardly in spaced relation from said upper frame cross brace, said lower frame cross brace including a second catch member having a second depending portion extending generally upwardly in spaced relation from said lower frame cross brace generally toward said first catch member, said second upper and lower mounting brackets being configured to releasably engage said first and second catch members, respectively, said upper and lower mounting brackets each comprising a pair of openings separated by a middle portion, each of said first and second catch members comprising a slot generally centrally disposed on said first and second depending portions, said depending portions being received in said openings, said middle portions being received in said slots.

36. The rolling record case of claim 35, wherein the outer surface of the record case is covered with a sheet of scratch and dent resistant metal, and the scratch resistant metal is treated to provide an attractive appearance.

37. The rolling record case of claim 35, wherein the exposed corners of the record case are rounded and covered with a reinforcing material, to protect the corners of the record case during transport, storage, and use.

38. The rolling record case of claim 35, wherein the lower surface of the hand grip portion is molded to conform to the grip of a user's fingers as the user grasps the hand grip.

39. The rolling record case of claim 35, wherein two wheels are permanently secured in spaced relation within partial recesses provided upon the record case housing, and an additional wheel is permanently secured to the hinged lid in axial alignment with the two wheels secured to the record case, to provide additional stability during use.

40. The rolling record case of claim 35 wherein each of said compartmented interior and said lid are configured to receive one or more of records, CDs DVDs, and combinations thereof.

41. A rolling record case with an extendable handle, comprising:

a) a record case sized to receive a plurality of records therein, the record case having a bottom portion, a front portion, a left side portion, a back portion, and a right side portion forming an open top compartmented interior therebetween;

b) a lid with a top portion, a depending front portion sized to engage the front portion of the record case, a depending left side portion sized to engage the left side portion of the record case, a depending rear portion sized to engage the rear portion of the record case; and a depending right side portion sized to engage the right side portion of the record case, said lid sized to be releasably and pivotally secured to the record case to selectively secure a plurality of records therein;

c) a frame portion, sized to be selectively mounted and releasably secured to one of the left side portion, the back portion, the right side portion and the bottom portion of the record case, the frame portion having a first side, a second side spaced from said first side, a wheel mounting end with an axle support extending between the first side and the second side of the frame portion near the wheel end, and a handle mounting end with a handle extending between the first side and the second side of the frame portion near the handle end, said frame portion being releasably secured to said record case between an upper mounting bracket secured to said record case and a spaced apart lower mounting bracket secured to said record case, said frame portion having an upper frame cross-brace and a spaced apart lower frame cross-brace, said upper and lower mounting brackets and said upper and lower frame cross-braces being engageable to removably secure said frame portion to said record case, said upper frame cross brace including a first catch member having a first depending portion extending generally downwardly in spaced relation from said upper frame cross brace, said lower frame cross brace including a second catch member having a second depending portion extending generally upwardly in spaced relation from said lower frame cross brace generally toward said first catch member, said second upper and lower mounting brackets being configured to releasably engage said first and second catch members, respectively, said upper and lower mounting brackets each comprising a pair of openings separated by a middle portion, each of said first and second catch members comprising a slot generally centrally disposed on said first and second depending portions, said depending portions being received in said openings, said middle portions being received in said slots.

* * * * *